US006916146B1

(12) United States Patent
Lonardi et al.

(10) Patent No.: US 6,916,146 B1
(45) Date of Patent: Jul. 12, 2005

(54) DEVICE FOR DISTRIBUTING BULK MATERIALS WITH ROTARY CHUTE HAVING A VARIABLE ANGLE OF INCLINATION

(75) Inventors: Emile Lonardi, Bascharage (LU); Giovanni Cimenti, Bertrange (LU); Jean-Jacques Venturini, Obercorn (LU)

(73) Assignee: Paul Wurth S.A., Luxembourg (LU)

( * ) Notice: Subject to any disclaimer, the term of this patent is extended or adjusted under 35 U.S.C. 154(b) by 257 days.

(21) Appl. No.: 10/070,151

(22) PCT Filed: Aug. 16, 2000

(86) PCT No.: PCT/EP00/07949

§ 371 (c)(1),
(2), (4) Date: Mar. 1, 2002

(87) PCT Pub. No.: WO01/18255

PCT Pub. Date: Mar. 15, 2001

(30) Foreign Application Priority Data

Sep. 3, 1999 (LU) ..... 90 433

(51) Int. Cl.[7] ..... B65G 65/28

(52) U.S. Cl. ..... 414/293; 414/172; 414/199; 414/299

(58) Field of Search ..... 414/293, 172, 414/184, 198, 199, 203, 205–208, 301, 299; 193/3, 16, 23

(56) References Cited

U.S. PATENT DOCUMENTS 2,833,586 A * 5/1958 McFeaters ..... 414/207
3,693,812 A * 9/1972 Mahr et al. ..... 193/3
3,899,088 A * 8/1975 Furuya et al. ..... 414/206
4,493,600 A * 1/1985 Legille et al. ..... 414/208
4,921,086 A * 5/1990 Klutz et al. ..... 193/3

FOREIGN PATENT DOCUMENTS

| | | |
|---|---|---|
| DE | 3342572 | * 12/1984 |
| FR | 882167 | 5/1943 |
| FR | 2692595 | 12/1993 |

* cited by examiner

*Primary Examiner*—Patrick Mackey
(74) *Attorney, Agent, or Firm*—McCormick, Paulding & Huber LLP

(57) ABSTRACT

A device for distributing materials in bulk includes a suspension rotor and a chute located below the suspension rotor. The chute is provided with two lateral suspension arms which are connected to the suspension rotor. A driving mechanism produces a pivoting torque capable of pivoting the chute, while a cylindrical suspension pin is associated with each suspension arm for pivotably connecting it to the suspension rotor. A control lever is connected to the suspension rotor, the driving mechanism being connected to the control lever so as to transmit to the latter the pivoting torque. A stop on the control lever and a counterstop on a suspension arm engage with each other to transmit the pivoting torque to the suspension arm. The stop and the counterstop are disengagable by a translation movement of the two suspension arms after withdrawal of the cylindrical suspension pins for removal of the chute.

11 Claims, 3 Drawing Sheets

DEVICE FOR DISTRIBUTING BULK MATERIALS WITH ROTARY CHUTE HAVING A VARIABLE ANGLE OF INCLINATION

FIELD OF THE INVENTION

The present invention relates to a device for distributing materials in bulk with a rotary chute having a variable angle of inclination. It relates more particularly to such a device comprising a suspension rotor, a chute provided with two suspension arms, each of which is connected to the suspension rotor by means of a suspension pin in such a way as to define on the suspension rotor a pivoting axis for the chute, and a driving mechanism to produce a pivoting torque capable of pivoting the chute about its pivoting axis.

BACKGROUND OF THE INVENTION

Such devices for distributing materials in bulk are for example used in installations for charging shaft furnaces, particularly blast furnaces, in which the rotary chute with a variable angle of inclination provides for the distribution of the charge inside the shaft furnace. It should be appreciated that, in such a device, the chute is an element subject to wear, which must be replaced from time to time. Hence the necessity of suspending the chute in an easily removable way in its suspension rotor while ensuring a reliable transmission of a large pivoting torque to the chute.

Devices for distributing materials in bulk with a rotary chute having a variable angle of inclination are described, for example, in U.S. Pat. No. 3,814,403, U.S. Pat. No. 5,022,806 and patent application DE 3342572.

The chute in the device described in U.S. Pat. No. 3,814,403 is provided with lateral suspension journals. On one side it comprises two separated suspension journals, which are received in two separated housings of a suspension flange driven in rotation by the pivoting mechanism so that this suspension flange can transmit the pivoting torque to the chute. On the opposite side, it comprises a single suspension journal, which can rotate in a housing of a fixed flange. The journals are fixed in the two flanges by means of transverse wedges.

The chute in the device described in U.S. Pat. No. 5,022,806 is also provided with lateral suspension journals. On one side it comprises two separated suspension journals, which are received in a housing of a suspension flange driven in rotation by the pivoting mechanism, so that this suspension flange can transmit the pivoting torque to the chute. On the opposite side, it comprises a single journal, which is received in the housing of a flange free to rotate on a pivot.

The chute of the device described in the patent application DE 3342572 is provided with two suspension arms of special shape. Each of these suspension arms is received in the housing of a suspension flange driven in rotation by the pivoting mechanism. The shape of the suspension arm provides for the housing of the suspension flange to be locked while allowing the chute to be easily withdrawn after it is raised. The two suspension flanges transmit the pivoting torque to the chute.

The charging device described in the patent application FR 882167 comprises an oscillating charging tube, which is suspended by means of two long horizontal arms like a pendulum in a rotary cylinder. The extremities of the suspension arms are mounted on bearings in the rotary cylinder.

One of these extremities carries an actuation lever. A knee-shaped control lever is fixed to the cylinder by means of a bearing. A first extremity of the control lever is connected by a connecting rod to an oscillation mechanism. A second extremity of the control lever bears a slide, which is guided in a closed runner of the activating lever. It is not described how to remove the charging tube.

SUMMARY OF THE INVENTION

An objective of the present invention is to propose a device for distributing materials in bulk provided with a simpler and more compact suspension for the chute, which nevertheless allows large pivoting torques to be transmitted to the chute while providing for easy removal and installation of the chute. In conformity with the invention, this objective is achieved by a device according to Claim 1.

A device for distributing materials in bulk according to the invention comprises a suspension rotor and a chute located below the suspension rotor. This chute is provided with two lateral suspension arms extending upwards where they are connected to the suspension rotor so as to define a roughly horizontal pivoting axis for the chute on the suspension rotor. The device also comprises a driving mechanism for producing a pivoting torque capable of pivoting the chute about its pivoting axis. A cylindrical suspension pin is associated with each suspension arm for pivotably connecting it to the suspension rotor. Each of these two cylindrical suspension pins is arranged in a retractable manner in a bearing of the suspension rotor. A control lever is connected to the suspension rotor by means of an articulated joint. The driving mechanism is connected to this control lever to transmit to the latter the pivoting torque. In order to transmit this pivoting torque to a suspension arm, the control lever is provided with a stop, which comes into contact with a counterstop provided on the respective suspension arm. The stop and counterstop are moreover designed in such a way that they can be disengaged by a translation movement of the two suspension arms after withdrawing the cylindrical suspension pins for removal of the chute. It should be appreciated that this device is distinguished by a very simple and very compact suspension of the chute, which enables large pivoting torques to be transmitted to the chute, while ensuring easy removal and installation of the chute.

The pivoting torque may be transmitted to the chute through only one of the two suspension arms. However, a symmetrical transmission of the pivoting torque to the two suspension arms is more advantageous. For this purpose, a control lever is associated with each of the two suspension arms and connected by means of an articulated joint to the suspension rotor. The driving mechanism is then connected to the two control levers to transmit the pivoting torque symmetrically to said levers. In this device, in order to transmit the pivoting torque to the two suspension arms of the chute, a stop on each of the two control levers cooperates with a counterstop on the suspension arm with which the respective control lever is associated.

It is of course possible to devise different driving mechanisms to transmit a pivoting torque to the control lever or levers. In a preferred embodiment, this driving mechanism comprises a control rotor having a rotation axis coaxial with the suspension rotor, and an angular drive carried by the suspension rotor. The input shaft of this angular drive is provided with a pinion, which meshes with an annular gear carried by the control rotor. Its output shaft is parallel to the pivoting axis of the chute and is driven in rotation when the input shaft is driven in rotation by the control rotor. A mechanism consisting of a crank and connecting rod connects the output shaft to the control lever or levers. It should be noted that a rotation of the input pinion of the angular drive takes place if there is a difference in angular speed between the suspension rotor and the control rotor. This rotation of the input shaft produces a rotation of the output shaft of the angular drive which is converted by the crank and connecting rod mechanism into a pivoting of the control lever or levers about their articulated joint or joints on the suspension rotor.

It is also possible to devise different embodiments of the stop and the counterstop. In a preferred embodiment, the stop is for example formed by a driving pivot carried by the control lever. The counterstop is then advantageously formed by a guiding slot made in said suspension arm of the chute. This guiding slot advantageously has an entrance in the free end of the arm so as to be able to introduce into it the driving pivot by a translation of the suspension arm in a direction perpendicular to the driving pivot.

In order to facilitate the installation and removal of the suspension pins, each of the two suspension arms of the chute advantageously comprises an oblong hole for the passage of its suspension pin, so that the two suspension pins can be freed by raising the chute.

In order to optimise the transmission of the pivoting torques from the control lever to the suspension arm, it is advantageous to have the suspension pin of the suspension arm and the articulated joint of the control lever substantially coaxial.

With the same objective, it is also advantageous to form the control lever from an assemblage of two symmetrical half-levers between which is then housed a free end of the suspension arm.

In a preferred embodiment, the device comprises an outer casing in which the suspension rotor is suspended. This casing is equipped with a lower screen, which is provided with a circular opening. The lower end of the suspension rotor carries a flange that is set into this circular opening. In this flange are positioned two elongated holes for the passage of the two suspension arms of the chute. Two supporting flanges flank each of the elongated holes for the support of the suspension pins at their two ends.

BRIEF DESCRIPTION OF THE DRAWINGS

Other special features and characteristics of the invention will emerge from the detailed description of an advantageous embodiment given below as an illustrative example with reference to the appended drawings. The latter show.

DETAILED DESCRIPTION OF THE PREFERRED EMBODIMENTS

Figure 1:
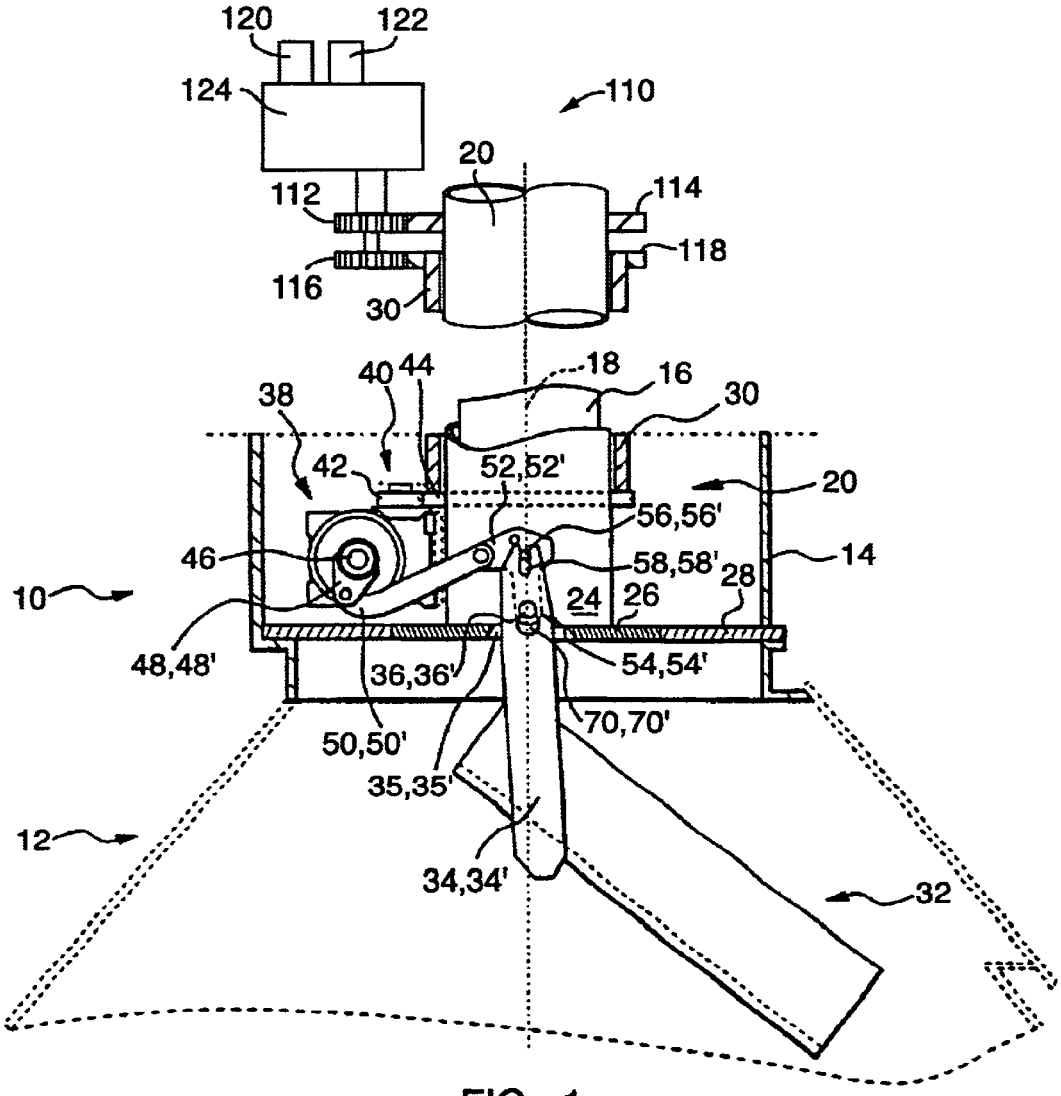
FIG. 1: a vertical cross-section through a device for distributing materials in bulk with a rotary chute having a variable angle of inclination.
Figure 2:
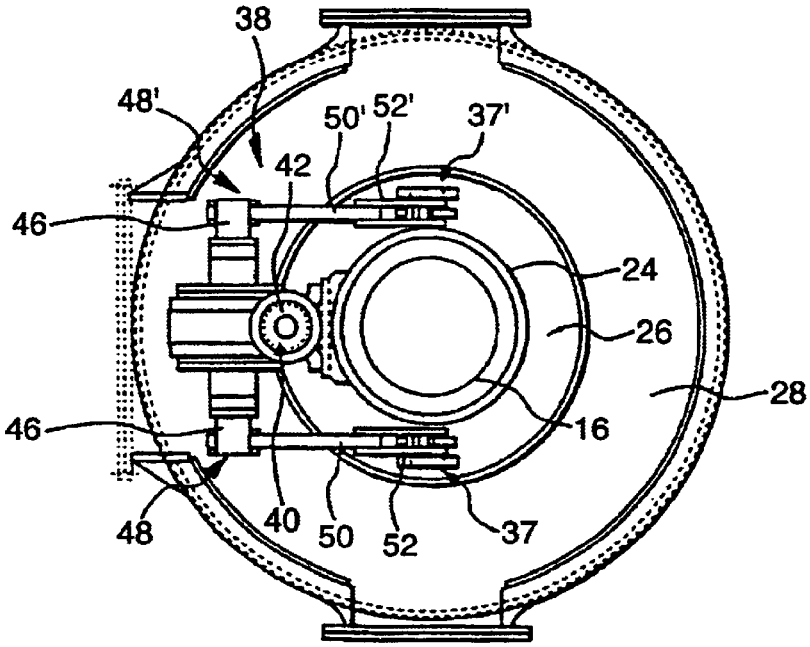
FIG. 2: a horizontal cross-section through the device in FIG. 1.

The device for distributing materials in bulk 10 shown in FIGS. 1 and 2 is more particularly intended to form part of a device for charging a shaft furnace, such as a blast furnace for example, represented schematically by its upper end 12.

This device 10 comprises an outer casing 14, which is connected in an impervious manner to the upper end 12 of the shaft furnace. This outer casing 14 is provided with a fixed charging duct 16, which is substantially coaxial with the vertical axis 18 of the shaft furnace and which emerges imperviously from the upper end (not shown) of the outer casing 14. A suspension rotor 20 is suspended in the outer casing 14, for example by means of a large diameter roller ring (not shown). This suspension rotor 20 comprises a vertical suspension sleeve 24 surrounding the fixed charging duct 16 and provided with a horizontal flange 26 at its lower end. This flange 26 is set into a circular opening of a lower screen 28 which separates the inside of the casing 14 from the inside of the furnace.

In FIG. 1, the reference number 30 denotes a second rotor, also called a control rotor 30. This control rotor 30 surrounds the suspension rotor 20 and is suspended in the outer casing 14, for example using a large diameter roller ring (not shown), so as to have its rotation axis substantially coaxial with the rotation axis of the suspension rotor 20. The two rotors 20 and 30 are driven in rotation by a driving device 110. This driving device comprises 110, in a way known per se, a first pinion 112, which meshes with an annular gear 114 of the suspension rotor 20, and a second pinion 116, which meshes with an annular gear 118 of the control rotor 30. With the help of two motors 120, 122 and a differential mechanism 124, which are installed outside the casing 14, this driving device is suitable for driving in rotation the two rotors 20, 30, either with perfectly synchronised rotational speeds or with different rotational speeds.

The reference number 32 denotes a chute for distributing, materials in bulk through the charging duct 16. This chute 32 comprises two lateral suspension arms 34, 34'. On both sides of the suspension sleeve 24, the flange 26 is provided with two elongated holes 35, 35' through which the free ends of the two suspension arms 34, 34' penetrate into the inside of the outer casing 14. Above the flange 26, the two suspension arms 34, 34' are connected to the suspension rotor 20 by means of two suspension pins 36, 36'. The latter are housed in bearings 37, 37' which are provided on the flange 26 on both sides of the suspension sleeve 24 so as to define on the suspension rotor 20 a substantially horizontal pivoting axis for the chute 32.

The reference number 38 denotes in a general way an angular drive carried by the flange 26 of the suspension rotor 20. This angular drive 38 comprises a vertical input shaft 40, which is parallel to the rotation axis of the two rotors 20, 30 and which is fitted with a pinion 42 meshing with an annular gear 44 on the control rotor 30. It also comprises a horizontal output shaft 46, which is parallel to the pivoting axis of the chute 32 and which has two free ends, each provided with a crank 48, 48'. A system of gears interconnects the input shaft 40 and the output shaft 46 in such a way as to convert a rotation of the vertical input shaft 40 into a rotation of the horizontal output shaft 46.

Two connecting rods 50, 50' connect the two cranks 48, 48' symmetrically to two control levers 52, 52', each of which has roughly the shape of a right-angle bracket with two arms. For each of these two control levers 52, 52', the end of one of these arms is connected by an articulated joint to its connecting rod 50, 50', while the end of the other arm is connected by means of an articulated joint 54, 54' to the suspension rotor 20. These articulated joints 54, 54' define for each control lever 52, 52' on the suspension rotor 20 a pivoting axis substantially coaxial with the pivoting axis of the chute 32.

It was seen above that a rotation of the input pinion 42 of the angular drive 38 produces a rotation of the cranks 48, 48'. This is converted by the connecting rods 50, 50' into a symmetrical pivoting of the two control levers 52, 52' about their articulated joints 54, 54'. Now, a rotation of the input pinion 42 occurs if there is a difference in angular speed between the suspension rotor 20 and the control rotor 30. In other words, to cause the two control levers 52, 52' to pivot symmetrically about their articulated joints 54, 54', it is sufficient to drive the control rotor 30 at an angular speed different from that of the suspension rotor 20.

According to an important feature of the present invention, the transmission of a pivoting torque from the control levers 52, 52' to the suspension arms 34, 34' relies on a stop-counterstop system, in which a stop on the control lever 52, 52' simply comes into contact with a counterstop on the suspension arm 34, 34' in order to transmit the pivoting torque. The stop is for example formed by a driving pivot 56, 56' carried by the control lever 52, 52', while the counterstop is then formed by a guiding slot 58, 58'. The latter is advantageously provided in the free end of the suspension arm 34, 34' and makes in the latter an entrance, so that the driving pivot 56, 56' can be introduced into its slot 58, 58' by a simple translation of the suspension arm 34, 34' in a direction perpendicular to the driving pivot 56, 56'.

Figure 4:
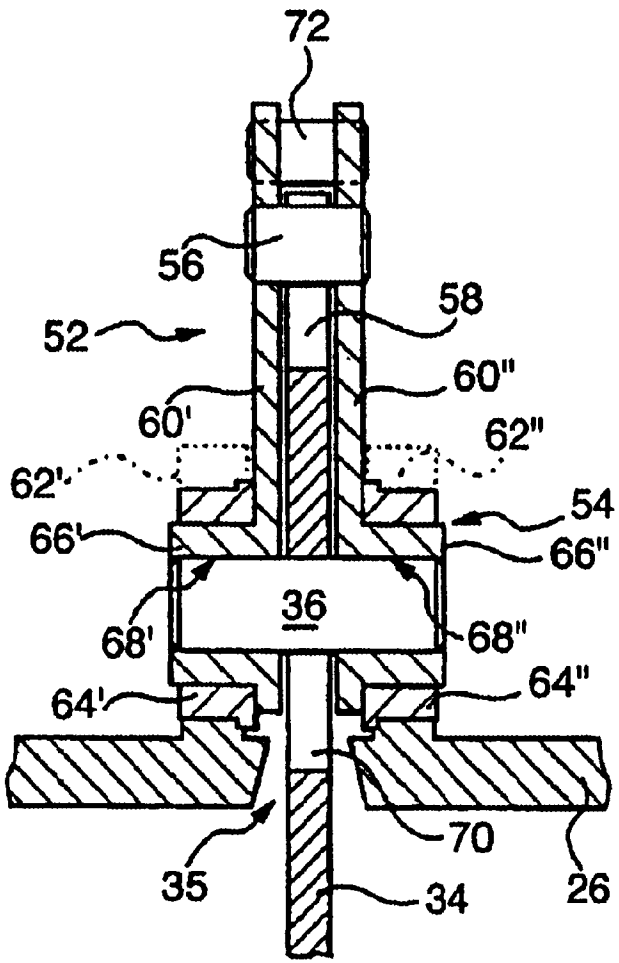
FIG. 4: a vertical cross-section showing details of the suspension of the chute of the device in FIG. 1.

FIG. 4 shows a preferred embodiment of the control lever assembly 52, the suspension pin and the suspension arm 34. It can be seen that the control lever 52 is formed by an assembly of two symmetrical half-levers 60', 60", between which the free end of the suspension arm 34 is housed. Said suspension arm passes through the elongated hole 35, which is provided in the flange 26 of the suspension rotor 20 and which is flanked by two supporting flanges 62', 62". Each supporting flange 62', 62" is provided with a bush 64', 64". Said articulated joint 54 of the lever 52 on the suspension rotor 20 is then formed by mounting a journal 66' of the half-lever 60' in the bush 64' of the supporting flange 62' and a journal 66" of the half-lever 60" in the bush 64" of the supporting flange 62". Each of these two journals 66', 66" is also provided with a central bore 68', 68" against which one end of the suspension pin 36 bears. It should be noted that the central axis of the suspension pin 36 is substantially coaxial with the central axis of the articulated joint 54 of the control lever 52. Mechanical stops (not shown) provide for the axial blockage of the suspension pin 36. However, after removal of these mechanical stops, the suspension pin 36 can easily be withdrawn from its housing formed by the two bores 68', 68".

Figure 5:
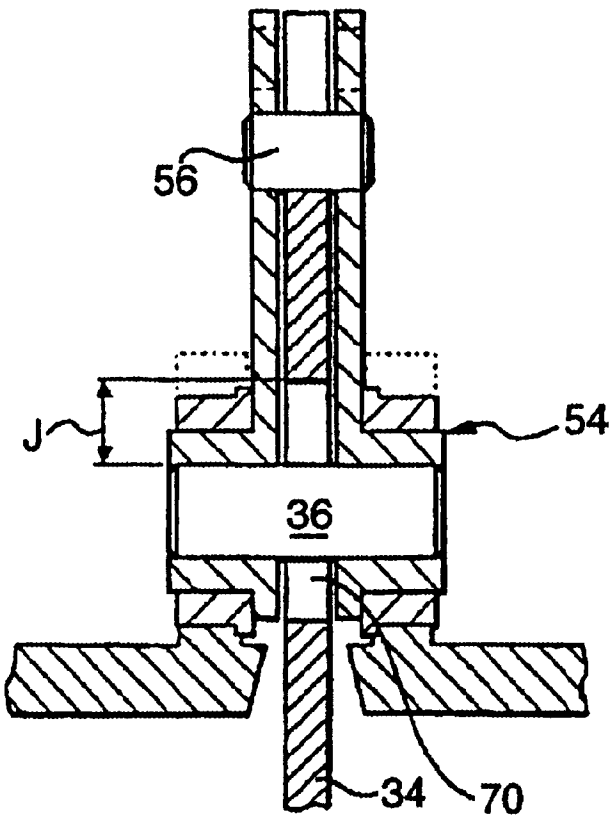
FIG. 5: a vertical cross-section similar to that in FIG. 4, illustrating the removal of the chute.

In order to facilitate the installation and removal of the suspension pins 36, 36', each of the two suspension arms of the chute incorporates an oblong hole 70, 70' for the passage of its suspension pin 36, 36'. This oblong hole 70, 70' is located along the extension of the slot 58, 58' so that the two suspension pins 36, 36' can be freed by raising the chute 32. This is illustrated by comparing FIGS. 4 and 5. In FIG. 4, the suspension arm 34 presses on the suspension pin 36 with the upper edge of its oblong hole 70. In FIG. 5, the chute 32 is in a raised position, in which there is a clearance "J" between the upper edge of the oblong hole 70 and the suspension pin 36 so as to free the suspension pin 36. It remains to note that the reference number 72 in FIG. 4 denotes a mechanical stop which prevents an unwanted raising of the chute 32. In FIG. 5, this mechanical stop 72 is removed.

Figure 3:
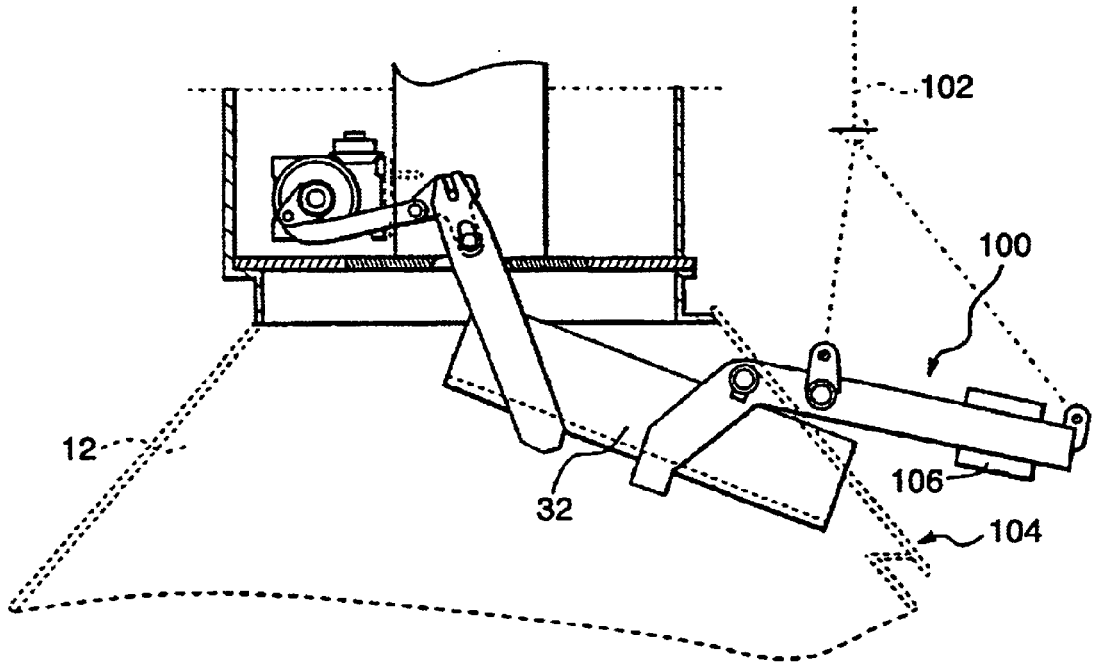
FIG. 3: a vertical cross-section similar to that of FIG. 1, illustrating the removal of the chute.

The procedure for removing the chute is illustrated by FIG. 3. The reference number 100 denotes a device for handling the chute 32 which is suspended from the cable 102 of lifting gear. This handling device 100 is coupled to the chute 32 through an opening for removal 104 provided in the upper end 12 of the shaft furnace. In a first step, the chute 32 is slightly raised in order to bring the two suspension pins 36, 36' into the position shown in FIG. 5 by a translation of the two suspension arms 34, 34'. In this position, it is now easy to withdraw the two suspension pins 36, 36' from their respective housings. The chute 32 is then allowed to descend in order, by a translation of the two suspension arms 34, 34', to free the two driving pivots 56, 56' from their respective guiding slots 58, 58'. It is then possible to withdraw the chute 32 laterally through the opening for removal 104. A counterweight 106 on the handling device 100 keeps the chute 32 substantially parallel to itself during the whole operation of withdrawal. The operation of installing the chute is carried out in the opposite way.

What is claimed is:

1. A device for distributing materials in bulk comprising:

a suspension rotor;

a chute located below said suspension rotor, said chute being provided with two lateral suspension arms extending upwards where they are connected to said suspension rotor, so as to define on said suspension rotor a roughly horizontal pivoting axis for said chute;

a driving mechanism to produce a pivoting torque capable of pivoting said chute;

a cylindrical suspension pin that is associated with each suspension arm for pivotably connecting it to said suspension rotor, each of said cylindrical suspension pins being arranged in a retractable manner in a bearing of said suspension rotor;

a control lever connected by means of an articulated joint to said suspension rotor, said driving mechanism being connected to said control lever so as to transmit to the latter said pivoting torque; and a stop on said control lever and a counterstop on a suspension arm, said stop and said counterstop engaging with each other to transmit said pivoting torque to said suspension arm, and are designed in such a way that they can be disengaged by a translation movement of the two suspension arms, after withdrawal of said cylindrical suspension pins for removal of said chute.

2. The device according to claim 1, wherein:

a control lever is associated with each of said suspension arms and connected by means of an articulated joint to said suspension rotor;

said driving mechanism is connected to said control levers so as to transmit said pivoting torque symmetrically to said control levers; and a stop on each of said control levers cooperates with a counterstop on the suspension arm with which the respective control lever is associated in order to transmit said pivoting torque to said suspension arms.

3. The device according to claim 2, wherein said driving mechanism comprises:

a control rotor having a rotation axis coaxial with said suspension rotor, said control rotor being provided with an annular gear;

an angular drive that is carried by said suspension rotor and includes:

an input shaft that is provided with a pinion meshing with said annular gear of said control rotor; and an output shaft that is parallel to the pivoting axis of said chute and driven in rotation when said input shaft is driven in rotation by said annular gear of said control rotor; and a crank and connecting rod mechanism connecting said output shaft to the control levers.

4. The device according to claim 1, wherein:

said stop is formed by a driving pivot carried by said control lever; and said counterstop is formed by a guiding slot provided in said suspension arm.

5. The device according to claim 4, wherein:

said suspension arm of the chute comprises a lever arm with a free end; and said guiding slot has an entrance in said free end so that said driving pivot can be introduced into it by a translation of said suspension arm in a direction perpendicular to said driving pivot.

6. The device according to claim 1, wherein each of the two suspension pins is mounted in a removable way in a housing of said suspension rotor.

7. The device according to 1, wherein each of the two suspension arms comprises an oblong hole for the suspension pin associated therewith, so that said suspension pins can be freed by raising said chute.

8. The device according to claim 7, wherein said suspension pin in one of said suspension arms and said articulated joint of the associated control lever are substantially coaxial.

9. The device according to claim 8, wherein said control lever is an assembly of two symmetrical half-levers between which is housed a free end of said suspension arm.

10. The device according to claim 9, further comprising:

an outer casing in which said suspension rotor is suspended, said outer casing comprising a lower screen provided with a circular opening;

a flange carried by the lower end of said suspension rotor, said flange being arranged in said circular opening;

two elongated holes arranged in said flange for the passage of said suspension arms of the chute; and two supporting flanges flanking each of said elongated holes for supporting said suspension pins.

11. A device for distributing materials in bulk comprising:

a suspension rotor;

a chute located below said suspension rotor, said chute being provided with two lateral suspension arms extending upwards where they are connected to said suspension rotor, so as to define on said suspension rotor a roughly horizontal pivoting axis for said chute;.

a driving mechanism to produce a pivoting torque capable of pivoting said chute;

a cylindrical suspension pin that is associated with each suspension arm for pivotably connecting it to said suspension rotor, each of said cylindrical suspension pins being arranged in a retractable manner in a bearing of said suspension rotor;

a control lever connected by means of an articulated joint to said suspension rotor, said driving mechanism being connected to said control lever so as to transmit to the latter said pivoting torque;

a stop on said control lever and a counterstop on a suspension arm, said stop and said counterstop engaging with each other to transmit said pivoting torque to said suspension arm, and are designed in such a way that they can be disengaged by a translation movement of the two suspension arms, after withdrawal of said cylindrical suspension pins for removal of said chute; and wherein said control lever is an assembly of two symmetrical half-levers between which is housed a free end of said suspension arm.

* * * * *